US005375263A

United States Patent [19]

Cuccia

[11] Patent Number: 5,375,263

[45] Date of Patent: Dec. 27, 1994

[54] SKI POLE MITTEN

[76] Inventor: Joseph A. Cuccia, 8314 Maunalani Pl., Diamondhead, Miss. 39525

[21] Appl. No.: 41,652

[22] Filed: Apr. 1, 1993

[51] Int. Cl.[5] ..... A41D 19/00

[52] U.S. Cl. ..... 2/158; 2/17; 2/161.1

[58] Field of Search ..... 2/17, 16, 158, 161.1, 2/159, 160; 280/819, 821

[56] References Cited

U.S. PATENT DOCUMENTS

| | | | |
|---|---|---|---|
| 1,202,734 | 10/1916 | Kirby | 2/17 |
| 3,746,356 | 7/1973 | Shipstad . | |
| 3,874,686 | 4/1975 | Shipstad et al. . | |
| 4,213,205 | 7/1980 | Smith . | |
| 4,488,313 | 12/1984 | Delaney . | |
| 4,543,671 | 10/1985 | Monk | 2/158 |
| 4,698,851 | 10/1987 | Dunford et al. | 2/160 |
| 4,759,084 | 7/1988 | Madnick et al. | 2/158 |
| 4,856,112 | 8/1989 | Effle . | |
| 5,052,057 | 10/1991 | Fetner | 2/158 |

FOREIGN PATENT DOCUMENTS

| | | | |
|---|---|---|---|
| 675523 | 10/1990 | France | 2/158 |
| 1956533 | 5/1971 | Germany | 2/17 |
| 324503 | 2/1935 | Italy | 2/17 |
| 178402 | 7/1935 | Switzerland | 2/17 |
| 2241869 | 9/1991 | United Kingdom | 2/160 |

*Primary Examiner*—Clifford D. Crowder
*Assistant Examiner*—Paul C. Lewis
*Attorney, Agent, or Firm*—Richard C. Litman

[57] ABSTRACT

A mitten enclosure for the sport of downhill skiing is disclosed comprising a multi-layered, insulated, three panel construction outer shell material for accepting the hand and wrist of a skier as well as the grip portion of his/her ski pole. Flap openings along the bottom of the mitten facilitate the donning and doffing of the mitten as well as the placement of the ski pole therein. An aperture of substantially circular cross-section is located adjacent the end of the flap openings near the front end of the mitten to better receive the shaft of the ski pole. A pocket is also provided within the mitten for retaining and other hand warming materials. Further, a tether is removably attached to the inner portion of the mitten to retain the mitten to the ski pole avoiding the inadvertent loss thereof and to support the mitten along the shaft of the ski pole when not being utilized by the skier.

13 Claims, 3 Drawing Sheets

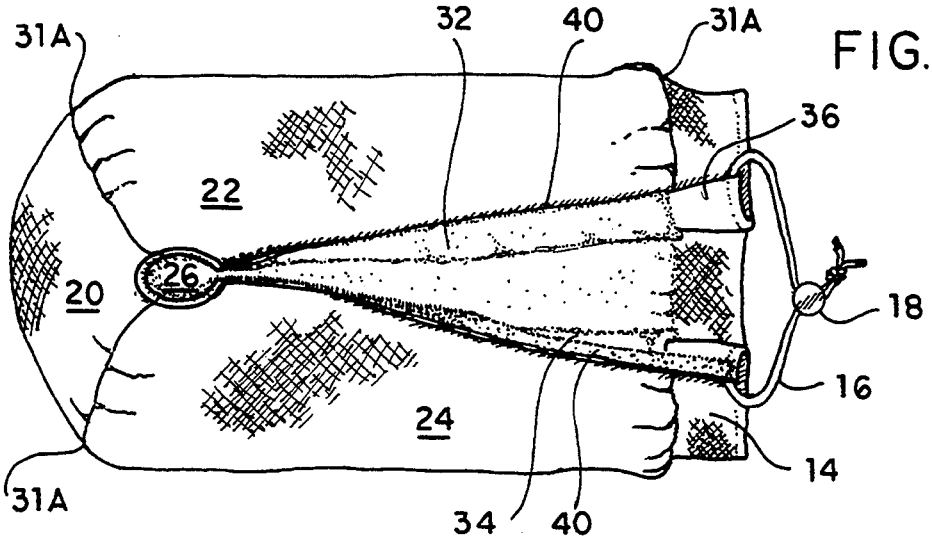
FIG. 3
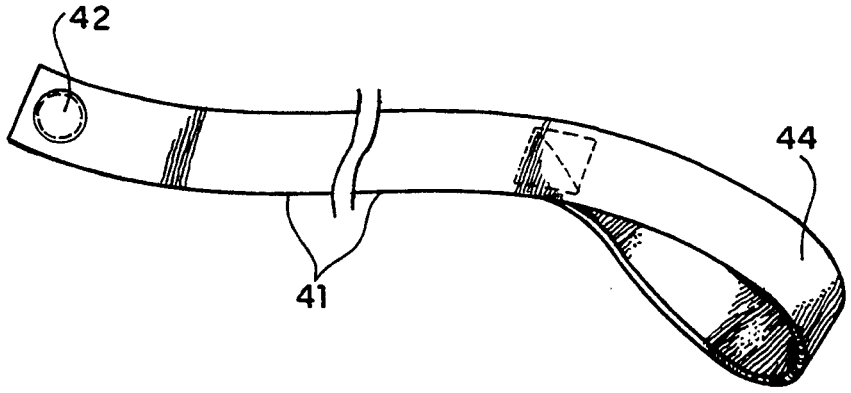
FIG. 4
FIG. 5
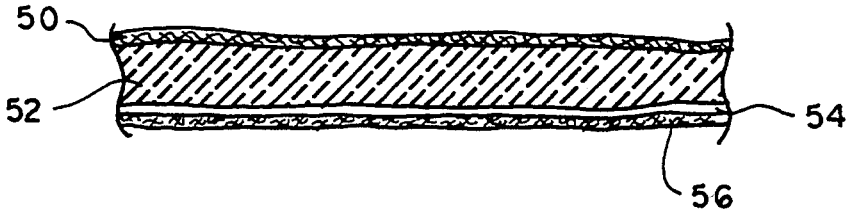

SKI POLE MITTEN

BACKGROUND OF THE INVENTION

1. Field of the Invention

The present invention relates to mittens used in the sport of skiing. It is known that a mitten, because it allows the digits of the hand to remain together, is a much warmer alternative to the standard gloves used in the industry. However, the thumb still is excluded from this warm area and the entire mitten itself is still exposed to the cold environment as well as cold winds encountered by a skier's hand while moving. However, a glove or mitten not allowing the thumb to move free from the other digits would make it extremely difficult to grasp the ski pole, unless the ski pole itself was accepted by such a glove or mitten.

A better mitten would be one that would completely cover the entire hand and wrist area of a gloved or bare hand to insulate such from the cold and to protect such from the wind while incorporating the grip of a ski pole therein. The instant invention presents such a device with further improvements. The present invention will insulate and shield a gloved or bare hand from the cold and wind, as well as provide additional heat to the hands of the skier while enclosing the hand, wrist, and ski pole grip of a ski pole, while retaining the mitten to the latter by tether means. The present invention further allows the skier to conveniently remove the mitten from its enclosing position over the hand, wrist, and ski pole grip while keeping it attached and adjacent the ski pole grip by tether means.

2. Description of the Prior Art

The instant invention provides a hand warmer enclosure for the hand and wrist of a skier as well as the grip of a ski pole having pockets therein for the securing of heat packs further combined with a tether to secure the hand warmer, or mitten, to the ski pole itself. Thus, use of the instant invention is particularly effective in keeping the hands warm as a skier skis, while being retained upon the hand, wrist, and pole itself. In addition, the mitten may be removed from the hand, wrist, and ski pole grip to a hanging position below the grip of the ski pole, supported by the tether, when the mitten is not needed.

The known prior art teaches somewhat related hand insulators and protector shields used in the ski industry as follows.

U.S. Pat. No. 3,746,356, issued Jul. 17, 1973 to Donald R. Shipstad, discloses a hand enclosure for ski poles which is capable of receiving the hand and wrist of a skier within a hard, one piece enclosure having a ski pole grip incorporated therein. Although some of the same benefits of the instant invention may be experienced by a skier wearing the Shipstad enclosure, functional and structural differences still remain. The Shipstad enclosure is seen as an un-insulated rigid enclosure having a ski pole grip integrally incorporated therein and, in a second embodiment, capable of opening and closing with fastening means about the user's hand and wrist. Shipstad's enclosure, however, is lacking many of the features of the instant invention including: a plurality of insulation material layers, means for accepting a hot pocket, as well as tether means for attaching the enclosure to the ski pole.

U.S. Pat. No. 3,874,686 issued on Apr. 1, 1975 to Donald R. Shipstad et al., discloses a ski pole hand shield and method of manufacture therefor. You will note that this second patent issued to Shipstad, despite having the capability of being turned inside out to facilitate the insertion of the end of a ski pole within the hand shield's grip, lacks many of the features of the present invention as noted above in the discussion of U.S. Pat. No. 3,746,356.

U.S. Pat. No. 4,213,205, issued on Jul. 22, 1980 to Nancy O. Smith, discloses a ski mitten primarily used in the sport of cross-country skiing. Smith's mitten comprises a thumbless enclosure of flexible, hand-protecting material having a generally triangular shape, extending forward from a deformable cuff that engages a skier's wrist. An opening to accept the ski grip of a ski pole is located along the bottom of the mitten at the front end thereof. This opening is secured about the pole by elastic means and is large enough to permit the passage of the skier's hand therethrough in order to facilitate unencumbered engagement of the hand and the ski pole grip. A material patch is attached to the interior of the mitten, opposite the ski pole opening for reinforcement purposes. Again, we do not see in Smith's patent, the use of a tether to secure such a mitten to the ski pole, a pocket located within the mitten to secure an item, particularly a heat pocket, therein, or a slot, defined by material flaps of the enclosure, extending from the cuff opening to the ski pole opening.

U.S. Pat. No. 4,488,313, issued on Dec. 18, 1984 to Richard D. Delaney, discloses an insulated ski glove for enclosing the hand and wrist of a skier as well as the skier's pole and grip thereon. Delaney's glove is constructed of a plurality of layers to form and insulated enclosure capable of receiving the grip of a ski pole within the glove and securing it therein by means of an exterior strap fastener that engages the pole and glove from the exterior thereof. The glove may be additionally secured to the hand of the skier by means of an elastic strap situated on the exterior of the glove. Delaney's glove is seen as having structural and functional differences in regard to the present invention.

Lastly, U.S. Pat. No. 4,856,112, issued on Aug. 15, 1989 to Michael D. Effle, discloses a powder cuff for use by an alpine, downhill, skier to prevent snow from entering the overlapping cuffs of the skier's gloves and the skier's jacket. Effle's powder cuff comprises a cylindrically shaped enclosure, open at both the front and rear ends so as to accept the wrist and arm, respectively, of a skier. Effle's powder cuff has two elastic bands attached to the exterior surface thereof to enhance the retention of the cuff on the individual's arm as well as a zipper-type fastener for closing a slot, defined by two flaps of the cuff, extending from the arm opening of the cuff to a point just short of the wrist opening of the cuff.

None of the above inventions and patents, taken either singly or in combination, is seen to describe the instant invention as claimed.

SUMMARY OF THE INVENTION

Accordingly, it is a principal object of the invention to provide a hand enclosure to insulate, heat, and protect the hand from the cold and wind while accepting and retaining the grip of a ski pole.

It is another object of the invention to provide a non-rigid hand enclosure for insulating, heating, and protecting the hand from the cold and the wind.

It is a further object of the invention to provide a hand enclosure having a pocket attached to the inner portion of the main body's main central panel and capable of being closed by a tab fastener.

Still another object of the invention is to provide a hand enclosure having flap means to aid in the insertion of a ski pole therein as well as facilitating the donning and doffing of an enclosure over a skier's hand.

Still another object of the invention is to provide means of attaching such an enclosure to a ski pole.

A further object of the invention is to provide releasable and adjustable means for attaching the enclosure to a ski pole.

It is a further object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a perspective view of the flexible tether.

FIG. 4 is a bottom view of the mitten enclosure, showing the flaps opened along the bottom portion thereof.

FIG. 5 is a view in section showing the material layers of the mitten enclosure.

Similar reference characters denote corresponding features consistently throughout the attached drawings.

DETAILED DESCRIPTION OF THE PREFERRED EMBODIMENTS

Figure 1:
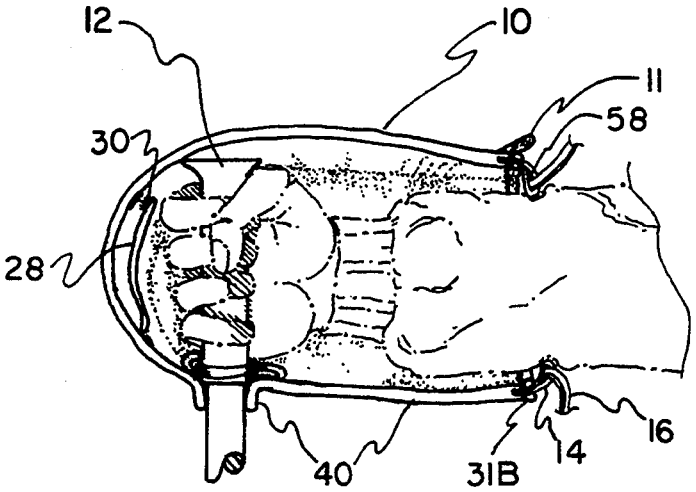
FIG. 1 is a simplified, cross-sectional side view of the mitten showing the preferred embodiment of the enclosure for receiving the hand and the grip of a ski pole.

Referring now in detail to the drawings, FIG. 1 illustrates a mitten 10 for enclosing the hand of a skier as well as the grip of a ski pole 12 therein. The skier's hand enters the mitten 10 through cuff 14 located at the rear open end of the mitten 10 which may be closed about the forearm of the skier by cinch cord 16 and secured by barrel fastener 18. The ski pole grip 12 enters the mitten 10 through a downward extending aperture 26 defined by the junction of material panels 20, 22, and 24; shown more clearly in FIG. 2. A pocket 28 is sewn to the main body center panel 20 at the front end portion to receive a heat pocket or any other well known means of exothermically dispensing heat to the interior portion of the mitten. Pocket 28 is retained in a closed position when the heat pocket is placed therein by a separable tab fastener 30. Preferably, separable tab fastener 30 is seen as a VELCRO hook and loop fastener.

Figure 2:
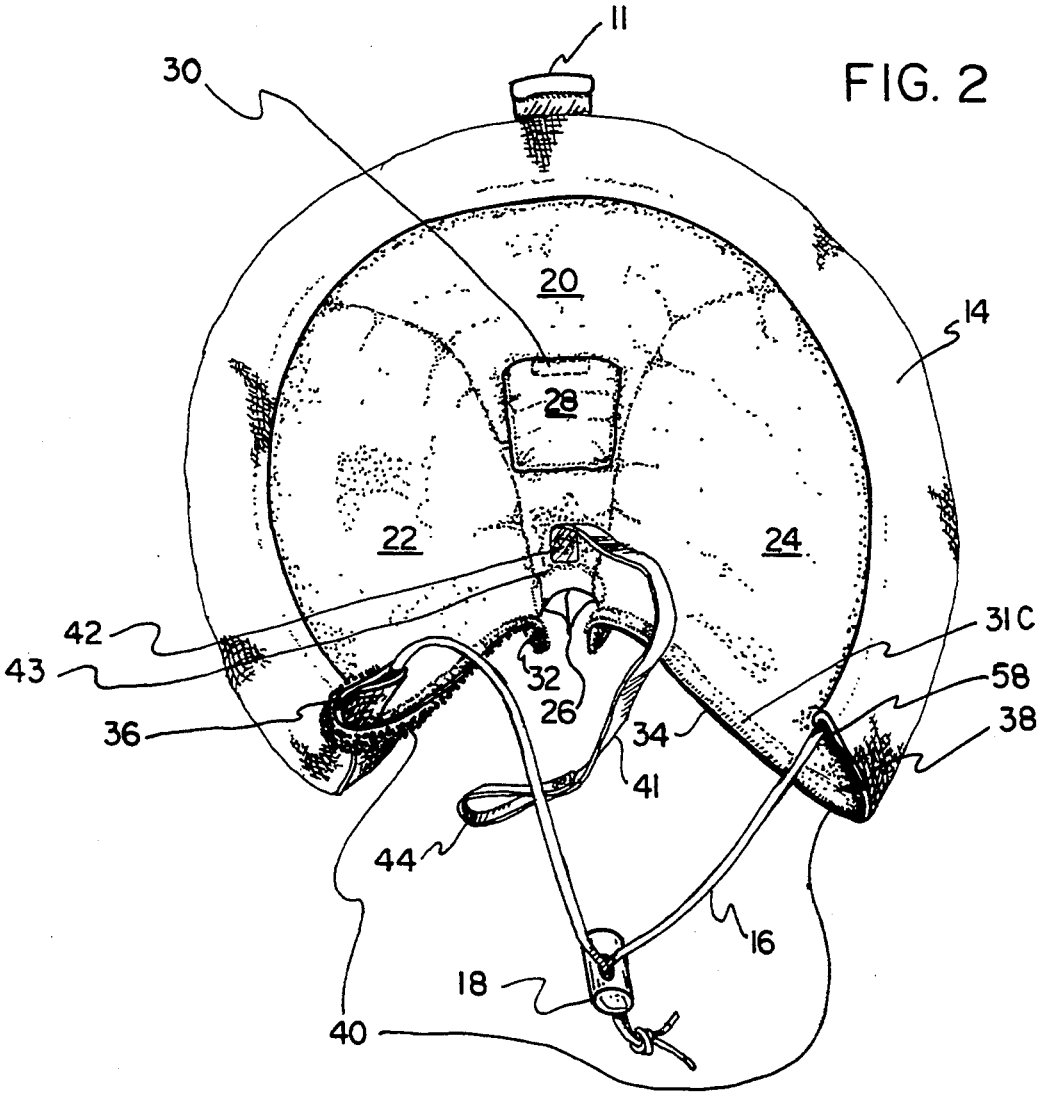
FIG. 2 is an end view of FIG. 1, showing the flaps opened along the bottom portion thereof.

More specifically referring to FIG. 2, the three material panels 20, 22, 24, that create the mitten enclosure are clearly seen herein. In addition, stitching 31*a*, is used to join these panels together from the rear opening of the mitten 10, along the edges of the respective panels; panel 20 sewn to panel 22 and panel 20 sewn to panel 24, thereby leaving the adjacent edges of panels 22 and 24 not sewn together. The adjacent edges of panels 22 and 24, flaps 32 and 34, respectively, are separably fastened to one another by means of fastening means 40 extending from the ski pole aperture 26, through rear opening of mitten 10, and extending up onto cuff 14. The cuff 14 is seen to be sewn with stitching 31*b*, seen in FIG. 1, to the rear opening of mitten 10 defined by the edges of panels 20, 22, and 24, having mating flaps 36 and 38 defining an opening thereon which corresponds to flaps 32 and 34 of the mitten enclosure, seen as the adjacent edges of panels 22 and 24, respectively. Said fastening means is sewn with stitching 31*c* to flaps 32 and 34 of the mitten as well as flaps 36 and 38 of the cuff 14. Fastening means 40 may be hook and loop fastener.

FIG. 3 illustrates a tether 41 utilized in retaining the mitten 10 to the ski pole grip 12. The tether 41 has a releasable fastening means 42 at one end as well as means to accept the ski pole grip 12 at the other end. The ski pole grip engagement means are seen in two preferred embodiments, the first is by an elastic loop 44, seen here in FIG. 3, sewn to tether 41. The second preferred ski pole grip engagement means (not shown) would be a cinch loop-type fastening means that would adjust through nonelastic means about the ski pole grip 12. Regardless of the ski pole grip engagement means, a preferred embodiment of releasable attachment means 42 is seen as a snap-type fastener joining the respective end of tether 41 to a mating snap fastener 43 attached to mitten 10 adjacent ski pole aperture 26 on panel 20 but below pocket 28.

Furthermore, FIG. 5 illustrates a typical cross-section of any of the three panels 20, 22, or 24. The material panels are seen to comprise a four layer construction using well-known materials to the ski apparel industry. The outer shell material 50 of any panel may be or another suitable, water repelling, snag resistant material. Moving inward from the outer shell 50, is a layer of insulation 52, Next, a thin stiffener layer 54 is placed between insulation layer 52 and the final interior material layer 56. These layers are sewn together with stitching 31*a* along the edges thereof. Additional stitching (not shown)may further be employed to strengthen the material panels and to provide for different colors of outer shell material 50 to be sewn thereto for decorative purposes.

The cuff 14 of the mitten 10 is best illustrated in FIGS. 1, 2, and 4. The cuff 14 is constructed of the same material 50 that is used for the outer shell portion of the mitten 10 and is fabricated from a panel-like pattern. The first edge cuff 14 is sewn to the rear opening of the mitten 10 in such a manner that flaps 36 and 38 of cuff 14 correspond with flaps 32 and 34 of the enclosure. The second edge, opposite the first, is folded over and sewn to itself to create a passageway 58 through which cinch cord 16 is retained. Enough material is utilized in creating the cuff so that when cinch cord 16, which is looped thorough passageway 58 of cuff 14, is drawn to create a smaller loop, cuff 14 is adjusted to create an opening 60 substantially smaller that the rear opening of the mitten 10 defined by the rear edges of mitten panels 20, 22, and 24.

In addition, a tab 11 of the same material of outer shell 50, is sewn into the stitching 31*b* between cuff 14 and rear opening of the mitten 10, opposite enclosure flaps 32, 34, 36, and 38 of mitten 10. Tab 11 may be seen as a single strap of shell material 50 looped and folded against itself whereby the free ends thereof are sewn into stitching 31*b* between rear opening of the mitten 10 and cuff 14. Tab 11 is incorporated with the mitten 10 so as to facilitate the donning and doffing thereof.

Figure 6:
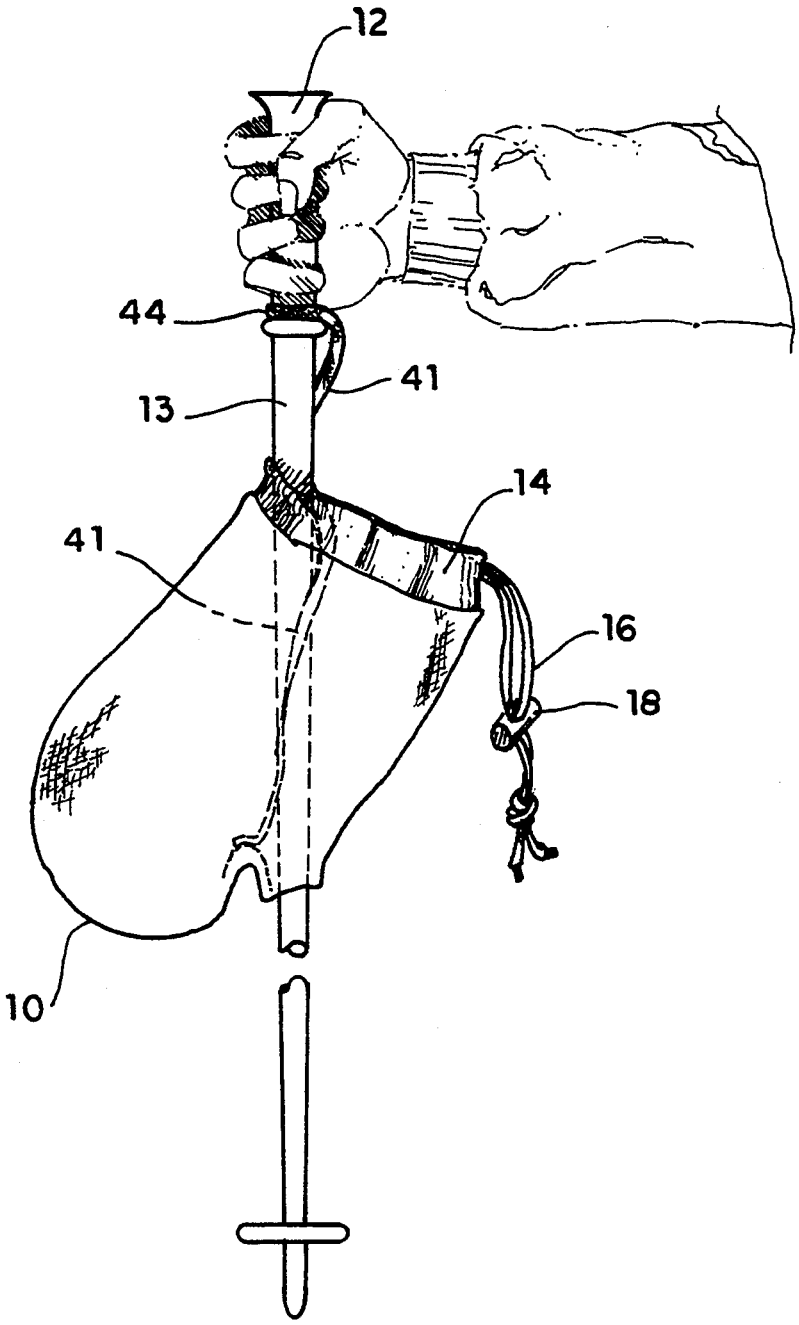
FIG. 6 is a side view of the mitten when suspended about the ski pole by the tether attached thereto.

Lastly, FIG. 6 illustrates how mitten 10 is supported by tether 41 when not in place over the skiers hand and wrist. When not needed by the skier, i.e. in the lift line or at the bottom of a mountain having varying peak and base elevation temperatures, the mitten 10 may be removed from the hand and wrist to be conveniently stored along the shaft of the ski pole 13. Tether 41 supports the weight of the mitten 10 from its loop 44 which is secured around ski pole grip 12. Furthermore, ski pole aperture 26 remains closed about ski pole shaft 13. The skier may then have access to his/her hand while the mitten 10 is securely positioned along the ski pole shaft 13.

It is to be understood that the present invention is not limited to the sole embodiment described above, but encompasses any and all embodiments within the scope of the following claims.

I claim:

1. A mitten for use by skiers while grasping a ski pole, comprising:

a main body having an interior defined by a first side panel having a first flap and a first rear portion, a second side panel having a second flap and a second rear portion, and a front panel, wherein said first rear portion and said second rear portion define a rear end including a hand access opening, a ski pole aperture located at the intersection of said first side panel, said second side panel and said front panel, said first and second body flaps forming a slot therebetween extending from said hand access opening to said ski pole aperture, a first fastener located along said first body flap, a second fastener located along said second body flap for fastening to said first fastener, and a flexible tether having first and second ends, wherein said first end is attached to said interior of said main body and said second end having means for engaging the ski pole.

2. The mitten according to claim 1, including: cuff means surrounding said main body hand access opening.

3. The mitten according to claim 1, including: pocket means attached within said cavity and inside said main body front end portion, capable of insertably receiving exothermic means within said pocket means.

4. The mitten according to claim 3, including; separable tab fastener means for securing said pocket means with said main body front end portion.

5. The mitten according to claim 4, wherein said separate tab fastener means comprises hook and loop material.

6. The mitten according to claim 1, wherein; said first fastener includes hook material, and said second fastener includes loop material.

7. The mitten according to claim 1, including: releasable attachment means connecting said tether means first end to said main body.

8. The mitten according to claim 1, wherein said engaging means is resilient.

9. The mitten according to claim 1, wherein said engaging means is adjustable, and nonresilient.

10. The mitten according to claim 1, wherein said ski pole aperture is contiguous with said slot.

11. The mitten according to claim 10, including; a tab attached adjacent said ski pole aperture, with fastening means on said table adapted to accept said tether means first end.

12. The mitten according to claim 11, wherein; said fastening means includes a snap-type fastener.

13. The mitten according to claim 1, wherein said first end of said tether is attached to said front panel.

* * * * *